US005955145A

United States Patent [19]

Kalvala et al.

[11] Patent Number: 5,955,145

[45] Date of Patent: Sep. 21, 1999

[54] PROCESS FOR FORMING A WEAR-RESISTANT COATING THAT MINIMIZES DEBRIS

[75] Inventors: Prasad Rao Kalvala; Durga Prasad Beesabathina, both of Hampton; Karl Erik Wiedemann, Seaford, all of Va.

[73] Assignee: Analytical Services & Materials, Inc., Hampton, Va.

[21] Appl. No.: 09/109,673

[22] Filed: Jul. 2, 1998

Related U.S. Application Data

[62] Division of application No. 09/079,039, May 14, 1998.

[51] Int. Cl.[6] ..... B05D 5/00; B05D 3/02

[52] U.S. Cl. ..... 427/246; 427/283; 427/383.3

[58] Field of Search ..... 427/383.3, 283, 427/246

[56] References Cited

U.S. PATENT DOCUMENTS

| | | | |
|---|---|---|---|
| 5,162,977 | 11/1992 | Paurus et al. | 361/401 |
| 5,292,553 | 3/1994 | Leture et al. | 427/244 |
| 5,800,575 | 9/1998 | Lucas | 29/25.42 |

*Primary Examiner*—Shrive Beck
*Assistant Examiner*—Jennifer Calcagni

[57] ABSTRACT

A process for forming a coated article having a wear resistant coating that minimizes the generation and effects of wear debris is provided. Three independent mechanisms are operative: hard crystalline debris are avoided by specifying that all coating phases harder than 1000 VHN be amorphous, large wear debris from the coating are avoided by including finely dispersed porosity in the coating, and debris in the wear area is removed by a textured surface on some portion of the coating. The process for applying the coating need not use materials that are extremely hazardous to man and the environment.

10 Claims, 6 Drawing Sheets

PROCESS FOR FORMING A WEAR-RESISTANT COATING THAT MINIMIZES DEBRIS

BACKGROUND—CROSS-REFERENCES TO RELATED APPLICATIONS

This is a division of Ser. No. 09/079,039, filed May 14, 1998.

BACKGROUND—FIELD OF INVENTION

This invention relates to a process for making coated articles, such as tools used for cutting, forming or removing material, and specifically it relates to the process for forming wear-resistant coatings that minimize the generation and effects of wear debris whereby the life and performance of coated articles are improved.

BACKGROUND—DISCUSSION OF PRIOR ART

Articles subjected to wear are damaged by wear debris that accumulate between the articles and an opposing surface. An opposing surface is a surface that an article touches or rubs. For an article such as a cutting tool, the opposing surface would be a workpiece. Cutting tools are tools used for cutting, forming, or removing material.

In the past, articles subjected to wear were made from hard materials and were wear resistant by virtue of their hardness. To make them more wear resistant, harder and harder materials were used. But this approach led to a fabrication problem: very hard materials are difficult to fashion. Even worse, it led to a toughness problem: hard materials are often very brittle. Thus, a practical limit was reached as to how hard certain articles could be made. Beyond that limit the costs were prohibitive and the article, while it might have been wear resistant, tended to break easily like glass.

To overcome the fabrication and toughness problems, it was reasoned that only the surface of the article need be hard. The body of the article could be a tough material that would resist breakage and the surface could be a hard coating that would resist wear. U.S. Pat. No. 4,734,339 to Schanchner et al. (1988) probably represents the ultimate article for this line of reasoning because it uses a crystalline diamond coating described as super hard. Many similar articles were developed: of these, the most popularly used coatings were composed of the nitrides and carbides of various metals such as titanium and zirconium. U.S. Pat. No. 3,900,592 to Kennedy (1975) discloses a method of depositing nitrides and carbides of titanium and zirconium by physical vapor deposition where the emphasis is on creating a hard coating, which by virtue of the process is crystalline, dense and smooth. Similarly, U.S. Pat. No. 3,874,900 to Post et al. (1975) discloses a method of depositing nitrides and carbides of titanium by chemical vapor deposition, which also is crystalline, dense and smooth. All these coatings had the problem that, when the article was subjected to wear, the coatings generated abrasive debris that damaged the article and the opposing surface.

Although hard coatings increased the life of the article they coated, their effectiveness was limited because the coatings were crystalline, dense and smooth. Being crystalline, the coatings tended to break into angular debris that easily became embedded in the article or opposing surface. These pieces were very abrasive because they were hard and crystalline. They abraded the hard coatings, from which they had broken off, as well as the softer materials of the opposing surface and the body of the article they were supposed to protect. The coatings, being dense, tended to break into large pieces having dimensions comparable to the thickness of the coating. The debris remained between the article and the opposing surface because the surface of the coating was smooth. The retained debris acted as abrasives, generated more debris, and accelerated wear. Thus, the added wear resistance hard coatings provided, was diminished by the generation of highly abrasive debris.

To avoid the generation of abrasive debris, one inventor abandoned the use of hard coatings. U.S. Pat. No. 5,630,826 to Sastri (1997) discloses the use of soft gold and silver coatings in a surgical cutting tool, but the parts of the tool coated were not the cutting portions. They were parts that experienced sliding contact with each other. In that invention it was important to completely avoid contamination and mechanical seizure that might result from metallic wear debris. Hence, the use of a soft metal. It is unlikely, however, that a soft metal coating would prove durable on the cutting portion of a tool, or that such a coating would promote life of a general article.

Because the crystalline form of hard coatings contributes to the formation of debris, means of managing crystal size, order, and composition have been devised. Crystalline forms of matter have a regular arrangement of atoms. Amorphous forms of matter lack this regular arrangement. Because they have less energy, nature generally prefers crystalline forms of matter, but under certain conditions, amorphous forms can be attained. U.S. Pat. No. 3,871,836 to Polk et al. (1975) discloses a cutting implement coated with a metal film that consisted of at least 50% amorphous metal. U.S. Pat. No. 4,743,513 to Scruggs (1988) discloses an article that is at least partially amorphous where the amorphous portion was a selected metal alloy with hardness greater than 1600 VHN. The coatings were tested using a liquid slurry instead of sliding contact so that resistance of such materials to wear against opposing surfaces was not demonstrated. Further, the disclosure emphasized that the material need not be entirely amorphous. U.S. Pat. Nos. 4,594,294 (1986), 4,708,653 (1987), and 4,716,083 (1987), all to Eichen et al., disclose the use of disordered boron-carbon coatings where the form of the coatings may be polycrystalline, microcrystalline, or amorphous. It states that coatings that are amorphous or essentially amorphous have the advantages of better adherence and resistance to fracture. U.S. Pat. No. 4,693,944 to Sugisawa et al. (1987) suggests that a less crystalline coating would resist fracture better, but states that such a coating did not prove to have satisfactory wear resistance. U.S. Pat. No. 5,707,748 to Bergmann (1998) specifies a hard coating with a very fine crystal size (crystal diameters were less than 1 micrometer). But nowhere did prior art recognize the importance of avoiding completely the presence of hard crystalline phases in the coating and thereby avoiding the generation of highly abrasive, hard crystalline debris.

Inventors have devised means for managing debris when debris could not be avoided. U.S. Pat. No. 5,702,483 to Kwong (1997) describes the use of a textured surface on a surgical implant. The textured surface promotes attachment and growth of fibrous tissue so that the tissue acts as a capsule to trap wear debris from the implant and prevent movement of the debris to other areas. U.S. Pat. Nos. 4,396,077 (1983) and 4,494,618 (1985), both to Radtke, disclose rotary drill bits for earth drilling that have means for flushing mud and wear debris from the cutting surfaces using a drilling fluid. The means of managing debris outlined in these inventions are specific to the particular applications (surgical implants and earth drilling) and have not been proven suitable for use with general coated articles.

Further inventions bearing on the present invention involve the use of textured surfaces. U.S. Pat. Nos. 5,025,547 (1991) and 5,508,119 (1996), both to Sheu et al., disclose textured rollers for metal forming operations. The texture prevents lubrication breakdown during large reductions because the texture acts as a lubricant reservoir. When lubrication breaks down, it leads to the generation of smut and wear debris. Thus, the texture prevents generation of debris but it cannot remove debris from the wear area because the texture is elongated in the direction of sliding to allow material, particularly lubricant, to escape from the texture. Similarly, U.S. Pat. No. 5,643,054 to Bach (1997) discloses a method of texturing the surface of a cylinder wall of an internal combustion engine to improve lubricant retention.

In prior art, porosity was usually considered undesirable. U.S. Pat. Nos. 4,173,685 to Weatherly (1979) and 5,648,119 to Grab et al. (1997) emphasize the absence of interconnected porosity in their wear-resistant coatings. U.S. Pat. No. 5,713,129 to Rastegar (1998) discloses a wear-resistant coating having less than 5% total porosity. But other inventors have used porosity for a variety of purposes: U.S. Pat. Nos. 4,621,026 (1986), and 4,484,988 (1984), both to Robinson, disclose wear-resistant coatings having porosity that was filled with solid lubricants. U.S. Pat. No. 5,738,697 to Wu et al. (1998) discloses an abrasive wheel with interconnected porosity to allow the flow of fluids through the wheel as a means for flushing debris. But finely dispersed porosity has not been used to limit the size of debris produced by a wear-resistant coating.

Wear-resistant coatings have been applied by numerous methods that were elaborate, expensive, and hazardous to man and the environment. The methods required the use of expensive equipment and facilities. They used gases such as hydrogen, dry ammonia, methane, and metal halides. Further, the methods had difficulty coating intricate geometries and hidden surfaces. In work relevant to the current invention, Jaschek et al (J. of Non Cryst. Solids, v135, 1991, pp. 236–242) and Kamiya et al. (J. Am. Ceram. Soc., v73, 1990, pp. 2750–2752) describe methods for preparing titanium nitride that use dry ammonia. They also specify processing temperatures too high for many materials used in the body of articles.

To summarize, all wear-resistant coatings known heretofore suffer from a number of disadvantages:

(a) The coatings tended to break into large pieces because they were hard and dense, and cracks tended to propagate through them readily. Under high stress conditions, such as those encountered in a cutting operation, the coatings broke into pieces having dimensions comparable to the coatings' thickness. These pieces became wear debris and fell into the gap between the tool and the workpiece where they behaved as abrasive grit generating more wear debris and damaging both the article and the opposing surface.

(b) The coatings produced hard crystalline wear debris because the coatings contained hard crystalline matter that tended to be brittle and to break along distinct cleavage planes and parting directions. The hard crystalline wear debris tended to have angular shapes that allowed the debris to become easily embedded in the body of the tool and the opposing surface where they would act abrasively.

Coatings containing hard crystalline matter consisted of many small individual crystals. Cracking along boundaries between crystals generated hard crystalline wear debris.

Some coatings containing hard crystalline matter also failed catastrophically because of volume changes produced by phase transformations induced by temperature changes thereby generating hard crystalline wear debris.

Coatings containing hard crystalline matter had anisotropic properties that varied according to crystallographic directions that led to roughness by uneven wearing of the surface and thereby increased friction and abrasive wear causing damage to the article and opposing surface.

Further, coatings containing hard crystalline matter did not provide optimum control over composition and atomic bonding being restricted by the thermodynamic relationships governing the regular arrangement of atoms in crystalline matter.

(c) The coatings failed to remove wear debris from the wear area because the surfaces of the coatings were smooth. Wear debris accumulated between the article and the opposing surface where they would damage the article and the opposing surface and generate yet more wear debris.

(d) The coatings were applied using methods that required large capital investment for equipment and facilities. The methods also had difficulty coating intricate geometries and hidden surfaces.

(e) The coatings were applied using materials that were extremely hazardous to man and the environment.

OBJECTS AND ADVANTAGES

Accordingly, several objects and advantages of this invention are to provide a process for making a coated article having a wear-resistant coating that minimizes the generation and effects of debris by:

(a) avoiding the generation of large wear debris, (b) avoiding the generation of hard crystalline wear debris, (c) removing wear debris from the wear area.

Further, an object of this invention is to use a process for applying the coating that avoids the need for the expensive equipment used in applying prior-art coatings, easily coats intricate geometries and hidden surfaces, and does not necessarily use materials that are extremely hazardous to man and the environment.

Further objects and advantages will become apparent from a consideration of the ensuing description and accompanying drawings.

REFERENCE NUMERALS IN DRAWINGS

Figure 1:
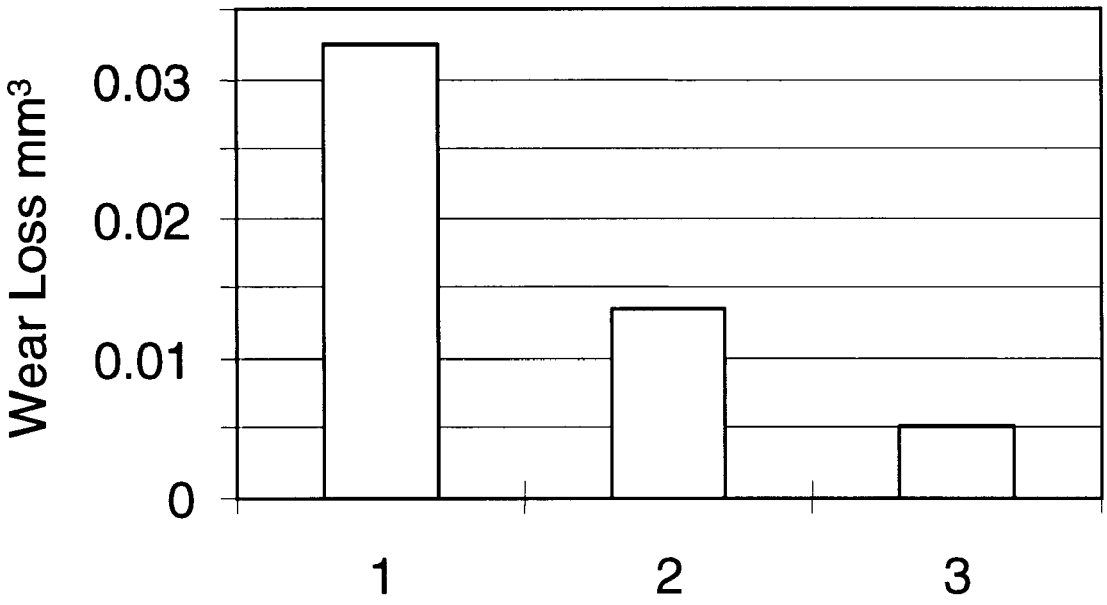
FIG. 1 shows the relative wear resistance of a nickel-based-alloy article before coating, after applying a comparable prior-art coating (titanium nitride applied by physical vapor deposition) and after applying a coating according to this invention.

1 wear loss of an uncoated article
2 wear loss of an article with a prior art TiN coating
3 wear loss of an article with coating of this invention
4 diffraction spectrum from an uncoated nickel-based alloy
5 diffraction spectrum from a nickel-based alloy with a coating of this invention
6 crystalline body-phase reflection
7 crystalline rutile reflection
8 crystalline anatase reflection
9 x-ray-photoelectron spectrum from a coating of this invention
10 calculated background for x-ray photoelectron spectrum
11 binding energy of titanium for crystalline $TiO_2$
12 binding energy of titanium for crystalline TiN
13 textured surface of a coating of this invention
14 wear debris
15 recess in the textured coating surface
16 opposing surface (machined steel ring) before wear
17 opposing surface (machined steel ring) after wear against nickel-based alloy
18 opposing surface (machined steel ring) after wear against a prior art TiN coating
19 opposing surface (machined steel ring) after wear against a coating of this invention

SUMMARY

In accordance with the present invention, a process is provided for making an article having a wear-resistant coating that has one or more of the following independent properties for minimizing the generation and effects of wear debris: all coating phases with hardness greater than 1000 VHN are amorphous, porosity that is finely distributed in the coating, and a surface texture on the coating that removes debris from the wear area. Further, the process for applying the coating need not use materials that are extremely hazardous to man and the environment.

DESCRIPTION OF INVENTION

A process is provided for making a coated article consisting of a body having one or more phases, and a wear-resistant coating having one or more phases. The coating covers some portion of the body and has at least one of the following independent properties: a) phases harder than 1000 VHN are amorphous, b) finely distributed porosity where the size of pores is less than 1 micrometer, or c) a textured surface covering some portion of the coating. For making the coating, a liquid precursor is prepared, applied to the body of the article, allowed to gel and then cured. A liquid precursor is a substance which will subsequently be changed to other forms of matter. Gelling is forming a solid from the applied liquid precursor. Curing is a process to put the coating into final form which may involve heating. A cutting tool according to this invention is an article used for cutting, forming, or removing material. Phases are forms of matter that have characteristic compositions and structures. Quantities expressed as VHN refer to the Vicker's Hardness Number scale.

EXAMPLES

These examples are preferred embodiments of this invention. In all cases, a liquid precursor is prepared, applied to the body of the article, allowed to gel and then cured. The amorphous forms of matter are achieved by using low processing temperatures. The incorporation of finely dispersed porosity is achieved by using a liquid precursor to form a gel that is then cured at low temperature to avoid densification. The surface texture used to remove debris is achieved through cracking of the gel during gelling and curing, or by casting using a textured mold. The texture can be deeper than 50% of the thickness of the coating.

Example 1

Tetrakis (diethylamino) titanium ($Ti(N(C_2H_5)_2)_4$) is used to prepare the precursor and all mixing, application, gelling and curing steps are done under a nitrogen purge.

Prepare precursor

According to this example, mix by weight in the following order and amount: 9 parts tetrakis (diethylamino) titanium ($Ti(N(C_2H_5)_2)_4$), 15 parts acetonitrile ($CH_3CN$), and 76 parts mono-n-butylamine ($CH_3(CH_2)_3NH_2$). Mix the chemicals in a glove box purged with nitrogen to eliminate water vapor. Maintain a continuous purge before, during and after mixing.

Age the mixture for at least two weeks under seal or a continuous nitrogen purge. The color of the precursor will gradually change from black to dark red. No precipitate should form during aging.

Apply precursor

Use one of the following methods to apply the precursor to the body of the article: a) spraying, b) dipping, c) brushing or d) casting. According to this example, mask the area to be coated with a polystyrene sheet having the shape of area to be coated. Place in a purged glove box. Cast the precursor by adding it drop-by-drop to the edge of sheet and allow it to be drawn between the sheet and the body of the article by capillary action. Since the sheet acts as a mold, it may be textured to produce a coating with a textured surface.

Gel precursor

Allow the cast precursor to remain covered by the sheet and under a nitrogen purge during gelling. Wait for the precursor to gel. This may require a few minutes to a few days. According to this example, wait 24 hours and then remove the sheet.

Cure by heating

According to this example, place the coated article in a furnace with a controlled atmosphere facility. Purge the furnace with nitrogen to remove oxygen and water vapor. Although different curing temperatures and curing times can be used, the preferred method is to cure for 1 hour at 650° C. During curing and subsequent furnace cooling, maintain a continuous nitrogen purge. Remove when furnace temperature falls below 250° C.

Example 2

Titanium isopropoxide is used to prepare the precursor and all mixing, application, and gelling is done under ambient conditions. Curing is by heating under a nitrogen purge.

Prepare precursor

According to this example, mix by weight in the following order and amount: 13 parts titanium isopropoxide ($Ti(OC_3H_7)_4$) and 68 parts mono-n-butylamine ($CH_3(CH_2)_3NH_2$). Mix thoroughly for 10 minutes and add 19 parts of acetonitrile ($CH_3CN$).

Apply precursor

Use one of the following methods to apply the precursor: a) spraying, b) dipping, or c) brushing. According to this example, the preferred method is to apply the coating by dipping. Dip the article into the above precursor and pull it out at a controlled speed. Though different pull out speeds can be used, according to this example, the speed of pulling out the article is 9 cm per minute.

Gel precursor

Allow the precursor to dry under ambient conditions. This should take from a few minutes to several hours. According to this example, allow 30 minutes.

Cure by heating

According to this example, place the coated article in a furnace with a controlled atmosphere facility. Purge with nitrogen. Although different curing temperatures and curing times can be used, the preferred method is to cure for 30 minutes at 500° C. During curing and subsequent furnace cooling, maintain a continuous nitrogen purge. Remove when furnace temperature falls below 250° C.

Example 3

The preparation, application, and gelling of the precursor are the same as in Example 2. The curing is done by heating under ambient conditions instead of a nitrogen purge.

Cure by heating

According to this example, place the coated article in a furnace. Although different curing temperatures and curing times can be used, the preferred method is to cure for 30 minutes at 500° C. Remove when furnace temperature falls below 250° C.

Example 4

In this example, tetraethoxysilane (TEOS), (2, 4) pentanedione, chromium nitrate and titanium isopropoxide are used to prepare the precursor. All mixing, application and gelling are done under ambient conditions. Curing is done by heating under a nitrogen purge.

Prepare precursor

According to this example, mix by weight in the following order and amount: 41 parts titanium isopropoxide ($Ti(OC_3H_7)_4$), 33 parts tetraethoxysilane ($(C_2H_5O)_4Si$), and 24 parts 2,4 pentanedione ($CH_3COCH_2COCH_3$). Add 2 parts chromium nitrate ($Cr(NO_3)_3$) and mix until the chromium nitrate dissolves completely.

Apply precursor

Use one of the following methods to apply the precursor: a) spraying, b) dipping, or c) brushing. According to this example, the preferred method is to apply the coating by dipping. Dip the article into the above precursor and pull it out at a controlled speed. Though different pull out speeds can be used, according to this example, the speed of pulling out the article is 9 cm per minute.

Gel precursor

Allow the precursor to dry under ambient conditions. This should take from a few minutes to several hours. According to this example, allow 30 minutes.

Cure by heating

According to this example, place the coated article in a furnace with a controlled atmosphere facility. Purge with nitrogen. Though different curing temperatures and curing times can be used, the preferred method is to cure for 30 minutes at 500° C. During curing and subsequent furnace cooling, maintain a continuous nitrogen purge. Remove when furnace temperature falls below 250° C.

OPERATION OF INVENTION

Articles resist wear better when coated with the coating using the process according to this invention than when coated with comparable coatings from prior art because the coating applied using the process according to this invention minimizes the generation and effects of wear debris significantly. Improved wear resistance of the coatings applied using the process according to this invention over a comparable prior-art coating (titanium nitride applied by physical vapor deposition) is shown in FIG. 1, where wear is indicated by volume loss. Although, the prior-art coating 2 wore less than an uncoated article 1, the coating according to this invention 3 wore least. These tests were conducted under identical conditions according to ASTM test method G77-83 with a load of 8.72 N, a speed of 109 rpm, at ambient temperature, without lubricant, and against machined steel rings. The steel rings were 52100 steel with a hardness of 58–62 HRc and a surface finish of 6–12 rms.

Figure 2:
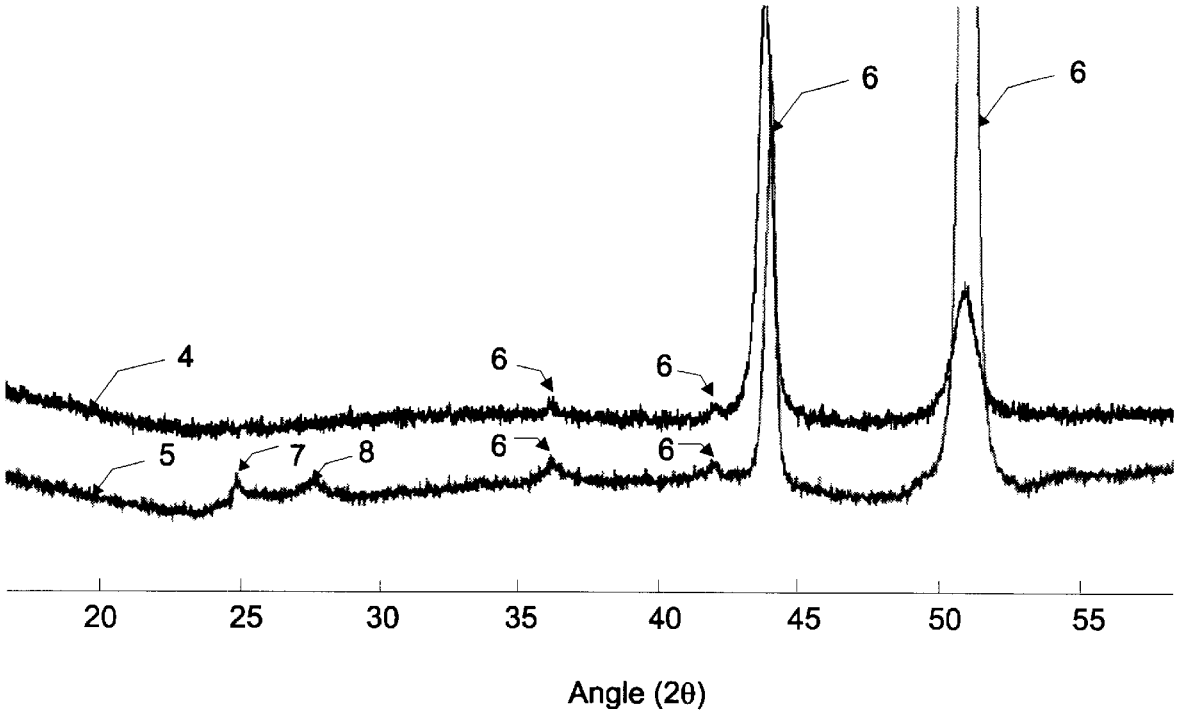
FIG. 2, an x-ray diffraction pattern, shows crystal phases present in a nickel-based-alloy article before and after application of a coating according to this invention.
Figure 3:
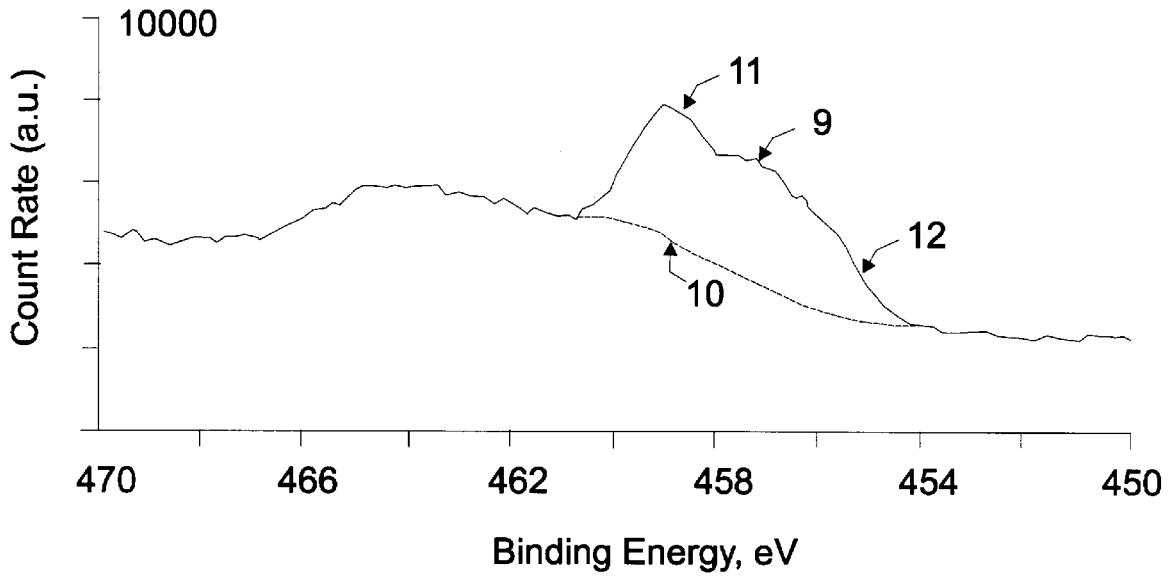
FIG. 3, an x-ray-photoelectron spectrum, shows the broad band of bonding energies observed in amorphous coating phases composed of titanium, oxygen, carbon and nitrogen.
Figure 4:
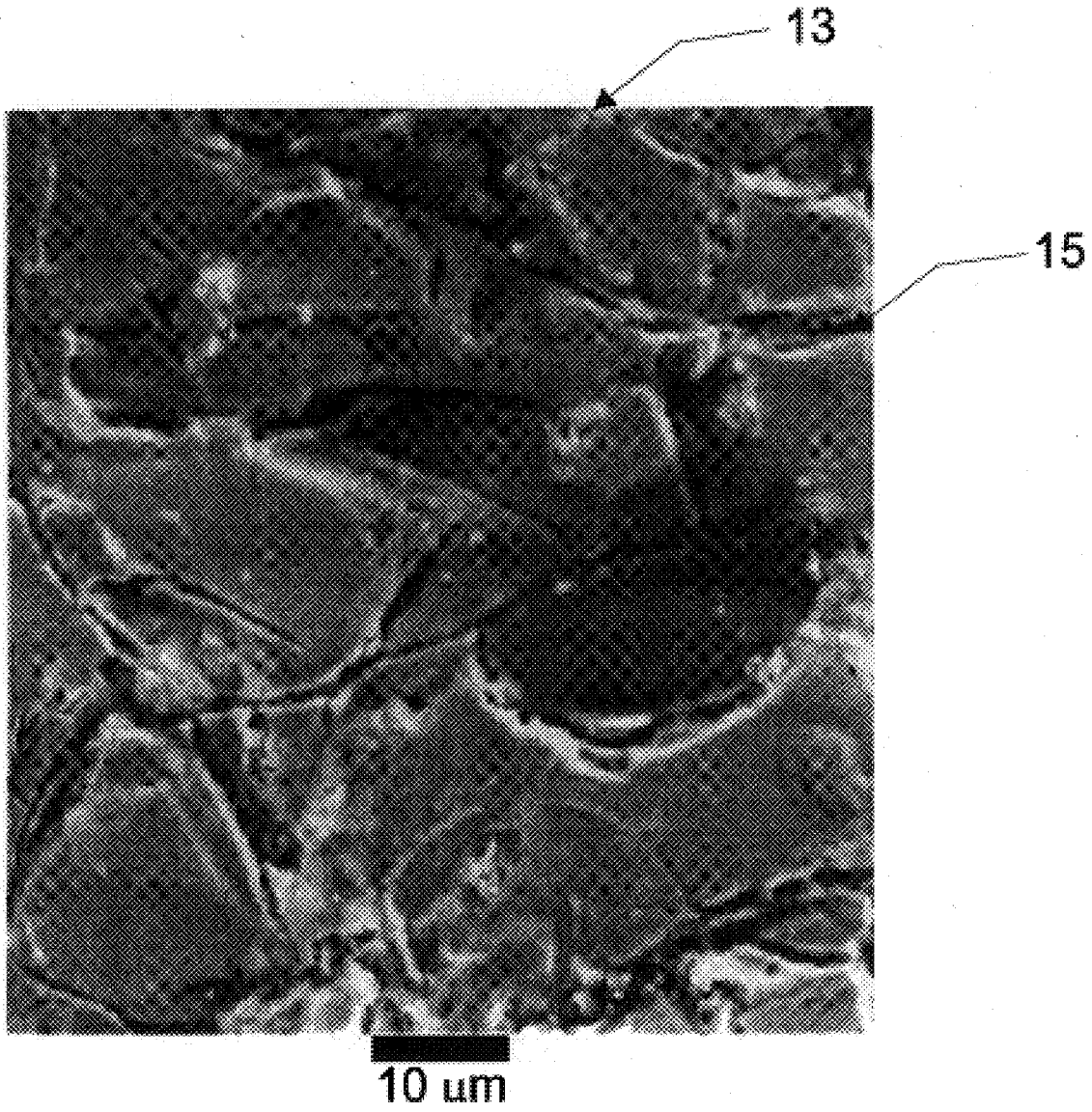
FIG. 4, a scanning secondary-electron micrograph, shows the surface texture of a coating that removes debris from the wear area.

The coating applied using the process according to this invention avoids formation of hard crystalline wear debris because the hard coating phases are amorphous. FIG. 2 shows x-ray diffraction spectra for a nickel-based alloy with no coating 4 and the same nickel-based alloy with the coating of this invention 5. Crystalline reflections from the body phases 6 are visible in both spectra. The only crystalline coating phases present were rutile 7 and anatase 8, which are soft having hardnesses <1000 VHN. No hard crystalline phases such as TiN or Ti (C, N) were observed although an amorphous phase containing titanium, nitrogen, oxygen and carbon was present. FIG. 3 shows an x-ray photoelectron spectrum from a coating of this invention 9, and a calculated background for that spectrum 10. The spectrum indicates that the binding energies of titanium are not those expected for crystalline titanium compounds 11 and 12. Instead, the binding energies of titanium cover a range that would not be expected in phases having an orderly arrangement of atoms.

The coating applied using the process according to this invention avoids generation of large wear debris by incorporating finely distributed porosity. When a piece of the coating breaks out, the piece is very small: about the size of the distance between pores. In addition, pores tend to toughen the coating by stopping cracks. As a result, the coating wears very smoothly and the wear area has a polished appearance. Porosity in these coatings is too small to resolve with a microscope, but from the optical properties of the precursors and coatings, it is possible to estimate that the size of the pores and the spacing between pores is less than 30 nanometers. The volume fraction of pores is typically between 3 and 80%.

Figure 5:
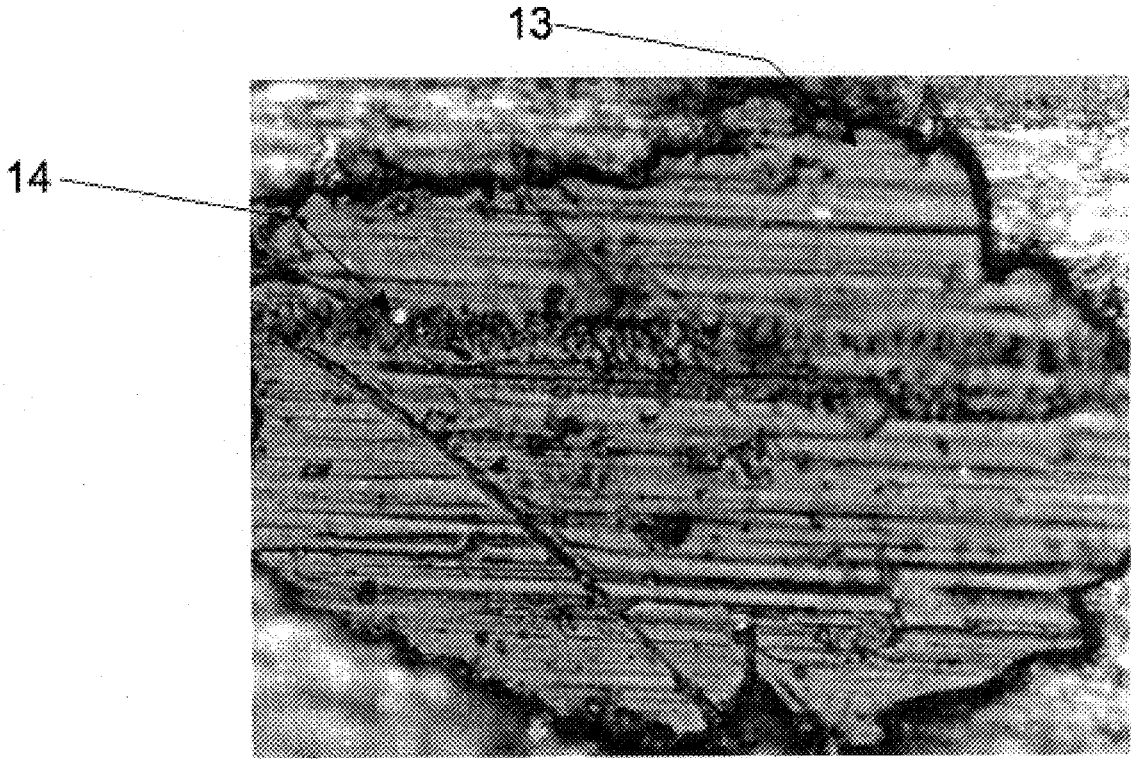
FIG. 5, an optical micrograph, shows debris removed from the wear area by the surface texture of the coating.
Figure 6:
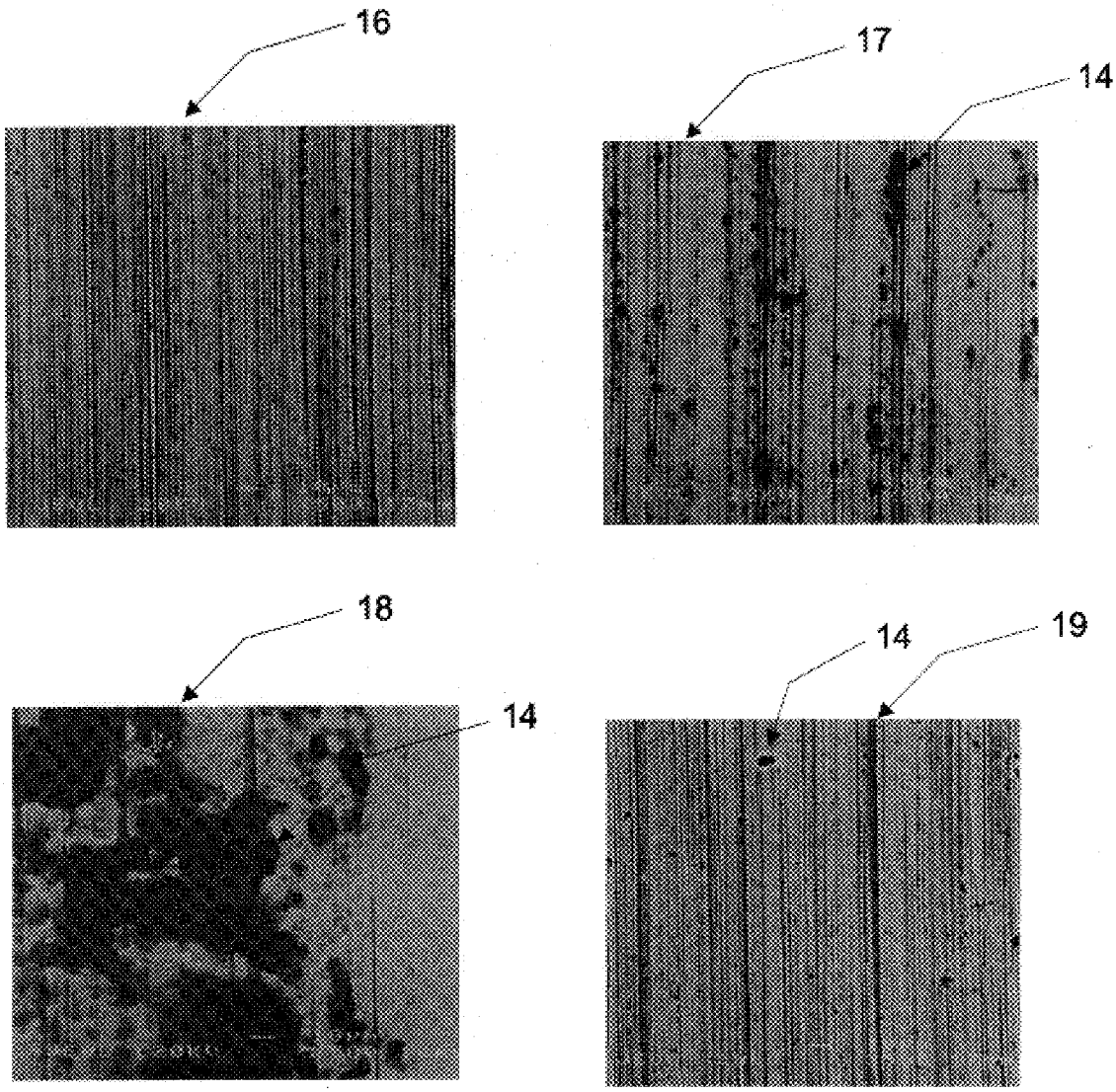
FIG. 6, scanning back-scattered-electron micrographs, shows opposing surfaces, which are machined steel rings, before and after wearing against articles.

The coating applied using the process according to this invention removes the wear debris from the wear area using a textured surface 13 that entraps wear debris. The textured surface, which is produced by the application process, provides recesses 15 where the debris 14 remains until the coating wears away as shown in FIG. 5. The entrapment of debris is effective in avoiding damage to the opposing surface. Opposing surfaces for various articles are shown in FIG. 6. The opposing surfaces are machined steel rings 16 on which machining marks are visible. After wear, debris 14 are visible on all the wear surfaces, but significantly less debris are visible on the opposing surface against the coating of this invention 19. It can be readily seen that the opposing surface against a comparable prior-art coating 18 (titanium nitride applied by physical vapor deposition) actually has more debris visible than the opposing surface against an uncoated article 17. This illustrates that the hard coatings from prior art, which are crystalline, dense and smooth, generate large quantities of abrasive debris that reduce the wear resistance provided by the coating.

Therefore, these findings show that the coated articles made by the process according to this invention resist wear better than comparable prior art by three independent mechanisms:

1. by requiring coating phases harder than 1000 VHN be amorphous to avoid the generation of hard crystalline wear debris,
2. by incorporating finely distributed porosity in the coating to avoid generation of large wear debris,
3. by removing wear debris using a textured surface.

Further, a process was used to apply the coating that did not need materials that are extremely hazardous to man and the environment.

The above examples and embodiments are presented to be typical of, rather than limiting on, the scope of the present invention, as will be appreciated by those skilled in the arts involved and as defined in the appended claims.

CONCLUSIONS, RAMIFICATIONS, AND SCOPE OF INVENTION

Accordingly, the reader will see that coated articles made by the process according to this invention resist wear better than comparable coatings from prior art because they minimize the generation and effects of wear debris using three independent mechanisms: specifying that all coating phases harder than 1000 VHN be amorphous, incorporating finely distributed porosity in the coating, and removing wear debris with a textured surface on the coating. Further, the reader will see that a coating according to this invention can be applied by a process that does not require expensive facilities or equipment, and that the process need not use materials that are extremely hazardous to man and the environment.

Although the above description contains many specificities, these should not be construed as limiting the scope of this invention, but as merely providing illustrations of some of the presently preferred embodiments of this invention. For example, the said coating may:

a) contain other elements such as aluminum, zirconium, hafnium, tungsten, boron, yttrium, lanthanum, cerium, gadolinium, iron, nickel, uranium and thorium,
b) be applied as multiple layers,
c) be applied to the substrate by other means such as spraying, or painting
d) be applied by other processes such as physical vapor deposition, chemical vapor deposition, and plasma spray,
e) be thicker or thinner or laminated with other coatings,
f) be applied to articles experiencing wear such as bearings, races, rings, guides, clips, slots, groves, valves, pistons, cylinders, pulleys, pads, gears, shafts, lifters, seals, gaskets, springs, bands, cams, seats, sleeves, fasteners, disks, blades, hydraulic actuator parts, internal combustion engine parts, and gas turbine engine parts,
g) be applied to tools such as drills, end mills, inserts, knives, shears, reamers, taps, milling cutters, hobs, dies, rollers, punches and grips.

We claim:

1. A process for making an article having a wear resistant coating comprising the steps of:

a) providing a liquid precursor with compositional means for forming phases with hardnesses greater than 1000 VHN wherein said compositional means comprises tetrakisdiethylamino titanium
b) applying said liquid precursor to a portion of said article's body to form an applied coating
c) causing said applied coating to gel while on said article to form a gelled coating
d) providing a curing means for curing the coating in final form
e) curing said gelled coating to form a final coating at a temperature that is at or below a maximum processing temperature and
f) limiting said maximum processing temperature to a predetermined temperature at or below which no crystalline phases having hardnesses greater than 1000 VHN will be formed in said final coating whereby said final coating contains hard phases and may contain crystalline phases that are soft but does not contain any crystalline phases that are hard so that the coating does not become a source of hard crystalline wear debris.

2. The process of claim 1 wherein said maximum processing temperature is 650° C.

3. The process of claim 1 wherein said compositional means further comprises acetonitrile and said curing means comprises a nitrogen purge.

4. A process for making an article having a wear resistant coating comprising the steps of:

a) providing a liquid precursor with compositional means for forming phases with hardnesses greater than 1000 VHN wherein said compositional means comprises tetrakisdiethylamino titanium
b) applying said liquid precursor to a portion of said article's body to form an applied coating
c) causing said applied coating to gel while on said article to form a gelled coating
d) providing a curing means for curing the coating in final form
e) curing said gelled coating to form a final coating at a temperature that is at or below a maximum processing temperature and
f) limiting said maximum processing temperature to a predetermined temperature at or below which porosity is substantially retained whereby said final coating has a tendency when breaking under excessive mechanical load to form small pieces of wear debris and does not become a source of large wear debris.

5. The process of claim 4 wherein said maximum processing temperature is 650° C.

6. The process of claim 4 wherein said compositional means further comprises acetonitrile and said curing means comprises a nitrogen purge.

7. A process for making an article having a wear resistant coating comprising the steps of:

a) providing a liquid precursor with compositional means for forming phases with hardnesses greater than 1000 VHN wherein said compositional means comprises tetrakisdiethylamino titanium
b) providing a texturing means for creating a textured surface on the coating
c) providing a application means for applying said liquid precursor to a portion of said body d) applying a liquid precursor to a portion of said article's body to form an applied coating e) causing said applied coating to gel while on said article to form a gelled coating f) providing a curing means for curing the coating in final form and g) curing said gelled coating to form a final coating whereby said final coating has a textured surface that tends to remove wear debris from portions of said final coating surface that make contact with an opposing surface.

8. The process of claim 7 wherein said compositional means further comprises acetonitrile and said curing means comprises a nitrogen purge.

9. The process of claim 7 wherein said texturing means comprises use of a textured mold and said application means comprises casting.

10. The process of claim 9 wherein said compositional means further comprises acetonitrile and said curing means comprises a nitrogen purge.

* * * * *